US009918174B2

(12) United States Patent
Tsilfidis et al.

(10) Patent No.: US 9,918,174 B2
(45) Date of Patent: Mar. 13, 2018

(54) WIRELESS EXCHANGE OF DATA BETWEEN DEVICES IN LIVE EVENTS

(71) Applicant: ACCUSONUS, INC., Lexington, MA (US)

(72) Inventors: Alexandros Tsilfidis, Athens (GR); Elias Kokkinis, Patras (GR)

(73) Assignee: ACCUSONUS, INC., Lexington, MA (US)

( * ) Notice: Subject to any disclaimer, the term of this patent is extended or adjusted under 35 U.S.C. 154(b) by 0 days.

(21) Appl. No.: 15/443,441

(22) Filed: Feb. 27, 2017

(65) Prior Publication Data

US 2017/0171681 A1 Jun. 15, 2017

Related U.S. Application Data

(63) Continuation of application No. 15/218,884, filed on Jul. 25, 2016, now Pat. No. 9,584,940, which is a continuation of application No. 14/645,713, filed on Mar. 12, 2015, now abandoned.

(60) Provisional application No. 61/952,636, filed on Mar. 13, 2014.

(51) Int. Cl.

| | |
|---|---|
| ***H04R 3/00*** | (2006.01) |
| ***H04R 29/00*** | (2006.01) |
| ***H04R 27/00*** | (2006.01) |
| ***H04R 3/04*** | (2006.01) |

(52) U.S. Cl.

CPC ..... *H04R 29/007* (2013.01); *H04R 3/04* (2013.01); *H04R 27/00* (2013.01); *H04R 29/008* (2013.01); *H04R 2227/001* (2013.01); *H04R 2227/003* (2013.01); *H04R 2227/009* (2013.01)

(58) Field of Classification Search

CPC ..... H04S 3/00; H04S 2400/15

See application file for complete search history.

(56) References Cited

U.S. PATENT DOCUMENTS

| | | | |
|---|---|---|---|
| 5,490,516 | A | 2/1996 | Hutson |
| 6,301,365 | B1 | 10/2001 | Yamada et al. |
| 6,393,198 | B1 | 5/2002 | LaMacchia |
| 6,542,869 | B1 | 4/2003 | Foote |
| 8,103,005 | B2 | 1/2012 | Goodwin et al. |
| 8,130,864 | B1 | 3/2012 | Lee et al. |
| 9,363,598 | B1 | 6/2016 | Yang |
| 9,584,940 | B2 | 2/2017 | Tsilfidis et al. |

(Continued)

FOREIGN PATENT DOCUMENTS

| | | |
|---|---|---|
| WO | WO 2013/030134 | 3/2013 |

OTHER PUBLICATIONS

Cichocki, Andrzej et al. "Nonnegative Matrix and Tensor Factorizations: Applications to Exploratory Multi-Way Data Analysis and Blind Source Separation" Chapter, 1, Sections 1.4.3 and 1.5; John Wiley & Sons, 2009.

(Continued)

*Primary Examiner* — Muhammad N Edun

(74) *Attorney, Agent, or Firm* — Jason H. Vick; Sheridan Ross., PC

(57) ABSTRACT

A method for wireless data exchange between devices in live events is presented. A method for exploring data of multiple devices in order to get information on the acoustic paths in different locations of venues is also provided. A method of exploring the microphones of sound-capturing devices of live event's audience is also presented.

10 Claims, 7 Drawing Sheets

(56) References Cited

U.S. PATENT DOCUMENTS

2003/0078024 A1 4/2003 Magee et al.
2003/0191638 A1 10/2003 Droppo et al.
2004/0213419 A1 10/2004 Varma et al.
2004/0220800 A1 11/2004 Kong et al.
2005/0069162 A1 3/2005 Haykin et al.
2005/0143997 A1 6/2005 Huang et al.
2005/0232445 A1 10/2005 Vaudrey et al.
2006/0056647 A1 3/2006 Ramakrishnan et al.
2007/0195975 A1 8/2007 Cotton et al.
2007/0225932 A1 9/2007 Halford
2008/0019548 A1 6/2008 Avendano
2008/0130924 A1 6/2008 Vaudrey et al.
2008/0152235 A1 6/2008 Bashyam et al.
2008/0167868 A1 7/2008 Kanevsky et al.
2008/0232603 A1 9/2008 Soulodre
2009/0080632 A1 3/2009 Zhang et al.
2009/0086998 A1 4/2009 Jeong et al.
2009/0094375 A1* 4/2009 Lection ..... G06F 15/16 709/231
2009/0132245 A1 5/2009 Wilson et al.
2009/0150146 A1 6/2009 Cho et al.
2009/0231276 A1 9/2009 Ullrich et al.
2009/0238377 A1 9/2009 Ramakrishnan et al.
2010/0094643 A1 4/2010 Avendano et al.
2010/0111313 A1 5/2010 Namba et al.
2010/0138010 A1 6/2010 Aziz Sbai et al.
2010/0174389 A1 7/2010 Blouet et al.
2010/0180756 A1 7/2010 Fliegler et al.
2010/0332222 A1 12/2010 Bai et al.
2011/0058685 A1 3/2011 Sagayama et al.
2011/0064242 A1 3/2011 Parikh et al.
2011/0078224 A1 3/2011 Wilson et al.
2011/0194709 A1 8/2011 Ozerov et al.
2011/0206223 A1 8/2011 Ojala
2011/0255725 A1 10/2011 Faltys et al.
2011/0261977 A1 10/2011 Hiroe
2011/0264456 A1 10/2011 Koppens et al.
2012/0101401 A1 4/2012 Faul et al.
2012/0128165 A1 5/2012 Visser et al.
2012/0130716 A1 5/2012 Kim
2012/0143604 A1 6/2012 Singh
2012/0163513 A1 6/2012 Park et al.
2012/0189140 A1* 7/2012 Hughes ..... H04M 3/56 381/123
2012/0207313 A1 8/2012 Ojanpera
2012/0213376 A1 8/2012 Hellmuth et al.
2012/0308015 A1 12/2012 Ramteke
2013/0021431 A1* 1/2013 Lemmey ..... H04N 21/47205 348/14.08
2013/0070928 A1 3/2013 Ellis et al.
2013/0132082 A1 5/2013 Smaragdis
2013/0194431 A1* 8/2013 O'Connor ..... H04N 21/21805 348/159
2013/0297298 A1 11/2013 Yoo et al.
2014/0037110 A1 2/2014 Girin et al.
2014/0218536 A1 8/2014 Anderson, Jr. et al.
2014/0358534 A1 12/2014 Sun et al.
2015/0066486 A1 3/2015 Kokkinis et al.
2015/0077509 A1 3/2015 Ben Natan et al.
2015/0181359 A1* 6/2015 Kim ..... H04S 7/30 381/92
2015/0221334 A1 8/2015 King et al.
2015/0222951 A1 8/2015 Ramaswamy
2015/0235555 A1 8/2015 Claudel
2015/0248891 A1 9/2015 Adami et al.
2015/0264505 A1 9/2015 Tsilfidis et al.
2015/0317983 A1 11/2015 Tsilfidis et al.
2016/0065898 A1 3/2016 Lee

OTHER PUBLICATIONS

Frederic, John "Examination of Initialization of Techniques for Nonnegative Matrix Factorization" Georgia State University Digital Archive @GSU; Department of Mathematics and Statistics, Mathematics Theses; Nov. 21, 2008.
Guy-Bart, Stan et al. "Comparison of Different Impulse Response Measurement Techniques" Sound and Image Department, University of Liege, Institute Montefiore B28, Sart Tilman, B-4000 Liege 1 Belgium, Dec. 2002.
Huang, Y.A., et al. "Acoustic MIMO Signal Processing; Chapter 6—Blind Identification of Acoustic MIMO systems" Springer US, 2006, pp. 109-167.
Schmidt, Mikkel et al. "Single-Channel Speech Separation Using Sparse Non-Negative Matrix Factorization" Informatics and Mathematical Modelling, Technical University of Denmark, Proceedings of Interspeech, pp. 2614-2617 (2006).
Wilson, Kevin et al. "Speech Denoising Using Nonnegative Matrix Factorization with Priors" Mitsubishi Electric Research Laboratories; IEEE International Conference on Acoustics, Speech and Signal Processing, pp. 4029-4032; Aug. 2008.
European Search Report for European Patent Application No. 15001261.5, dated Sep. 8, 2015.
Office Action for U.S. Appl. No. 14/011,981, dated May 5, 2015.
Office Action for U.S. Appl. No. 14/011,981, dated Jan. 7, 2016.
Office Action for U.S. Appl. No. 14/011,981, dated Jul. 28, 2016.
Office Action for U.S. Appl. No. 14/011,981, dated Feb. 24, 2017.
Office Action for U.S. Appl. No. 14/645,713 dated Apr. 21, 2016.
Notice of Allowance for U.S. Appl. No. 15/218,884 dated Dec. 22, 2016.
Office Action for U.S. Appl. No. 14/265,560 dated Nov. 3, 2015.
Office Action for U.S. Appl. No. 14/265,560 dated May 9, 2016.
Office Action for U.S. Appl. No. 14/265,560 dated May 17, 2017.
Advisory Action for U.S. Appl. No. 14/011,981, dated Aug. 10, 2017.
Notice of Allowance for U.S. Appl. No. 14/011.981, dated Sep. 12, 2017.
Office Action for U.S. Appl. No. 14/265,560 dated Nov. 30, 2017.
U.S. Appl. No. 15/804,675, filed Nov. 6, 2017, Kokkinis et al.

* cited by examiner

WIRELESS EXCHANGE OF DATA BETWEEN DEVICES IN LIVE EVENTS

CROSS-REFERENCE TO RELATED APPLICATIONS

This application is a contination of U.S. patent application Ser. No. 15/218,884, filed Jul. 25, 2016, now U.S. Pat. No. 9,584,940, which is a continuation of U.S. patent application Ser. No. 14/645,713, filed Mar. 12, 2015, which claims the benefit of and priority under 35 U.S.C. § 119(e) to U.S. Patent Application No. 61/952,636 filed Mar. 13, 2014, entitled "Ad-Hoc Wireless Exchange of Data Between Devices with Microphones and Speakers". In addition, this application is related to U.S. patent application Ser. No. 14/265,560, filed Apr. 30, 2014, entitled "Methods and Systems for Processing and Mixing Signals Using Signal Decomposition," each of which are incorporated herein by reference in their entirety.

TECHNICAL FIELD

Various embodiments of the present application relate to the wireless exchange of data between devices in live events. More specifically aspects of the present disclosure relate to improving the auditory experience and enhance the user-engagement of the audience before, during and after live events.

BACKGROUND

Live events include among others performances such as music, theater, dance, opera, etc. as well as other types of events such as sports, political gatherings, festivals, religious ceremonies, TV shows, games etc. The global financial impact of such events is massive and event organizers are interested in maximizing their financial revenues by creating a great user-experience for the event audience. The term audience here refers to not only those who are physically present in live events but also everyone who experiences live events via any medium, for example via broadcasting, recording, virtual reality reproduction, etc. Live events can be experienced either in real time or anytime after the actual time of the event. In all said cases, a very important aspect of the overall live events' user-experience is the auditory experience of the audience. Therefore, there's a need for new methods and systems that improve the auditory experience of live events.

In an indoor or outdoor live event, no matter how small or large, the main Public Address (PA) system is typically setup and tuned in an empty venue, e.g. without an audience present. Typically dedicated engineers take care to ensure homogeneous coverage of all audience positions in terms of sound pressure, loudness, frequency response or any other parameter. Such setup and tuning ensures high-quality auditory experience for the audience. However, this setup and tuning of the PA system is time-consuming and requires expensive equipment and highly-skilled professionals. Therefore in many live events, careful setup and tuning of the PA system is not performed and as a result the auditory performance can be bad or mediocre. Furthermore, even in cases where a careful setup and tuning of the PA system is performed, there's no way to achieve a perfect result since: (a) the behavior of the PA system will change over time according to environmental conditions (temperature, humidity, etc.) and (b) the appearance of the audience alters significantly the acoustic characteristics, mainly in indoor venues. In addition, the success of the setup and tuning of a PA system is limited by another fact: it's extremely difficult to perform measurements in all audience positions especially in larger venues. Therefore, only indicative measurements or coarse simulations are typically performed, resulting in a sub-optimal result for several venue positions. Therefore there's a need for methods and systems that perform continuous measurements in several venue positions at the time of live events.

Although live events are sometimes equipped with adequate professional equipment for reinforcing, recording and broadcasting, there are often limitations on the equipment quantity and quality, especially when the production budget is low. In addition even for expensive productions, there can be always limitations on the equipment placement. For example, a live sound engineer of a concert cannot place microphones in between the concert crowd. On the other hand, modern audience members carry with them portable devices including but not limited to smartphones, tablets, video cameras and portable recorders. These devices typically have sensors such as microphones and cameras, as well as significant processing power and they can transmit data wirelessly. Therefore, there is a need to harness the computing power and/or exploit the sensors of such devices in order to enhance among others the quality and quantity of the live event reinforcement, recording and broadcasting. Another factor that enhances the user-experience of live events is the user-engagement at the time of the event or later on. During each live event, the event audience can be engaged by actively participating in it. By giving said option to the live event audience, the event organizers can create immersive experiences for the users, increase the user-satisfaction and as a result transform the event audience from one-time users to loyal fans. Since live event audience already carries with them their portable devices, it might also make sense to allow them to use said devices in order to interact with or participate in the event. Therefore there is a need for new methods and systems that give the event audience the option to participate actively in live events by using their portable devices.

SUMMARY

Aspects of the invention relate to a method for wireless data exchange between devices in live events.

Aspects of the invention relate to a method for exploring data from multiple devices in order to get information on the acoustic paths of venues.

Aspects of the invention relate to a method for exploring data captured from microphones of devices of live event's audience.

BRIEF DESCRIPTION OF THE DRAWINGS

For a more complete understanding of the invention, reference is made to the following description and accompanying drawings, in which.

DETAILED DESCRIPTION

Hereinafter, embodiments of the present invention will be described in detail in accordance with the references to the accompanying drawings. It is understood that other embodiments may be utilized and structural changes may be made without departing from the scope of the present application.

The exemplary systems and methods of this invention will sometimes be described in relation to audio systems. However, to avoid unnecessarily obscuring the present invention, the following description omits well-known structures and devices that may be shown in block diagram form or otherwise summarized.

For purposes of explanation, numerous details are set forth in order to provide a thorough understanding of the present invention. It should be appreciated however that the present invention may be practiced in a variety of ways beyond the specific details set forth herein. The terms determine, calculate and compute, and variations thereof, as used herein are used interchangeably and include any type of methodology, process, mathematical operation or technique.

Figure 1:
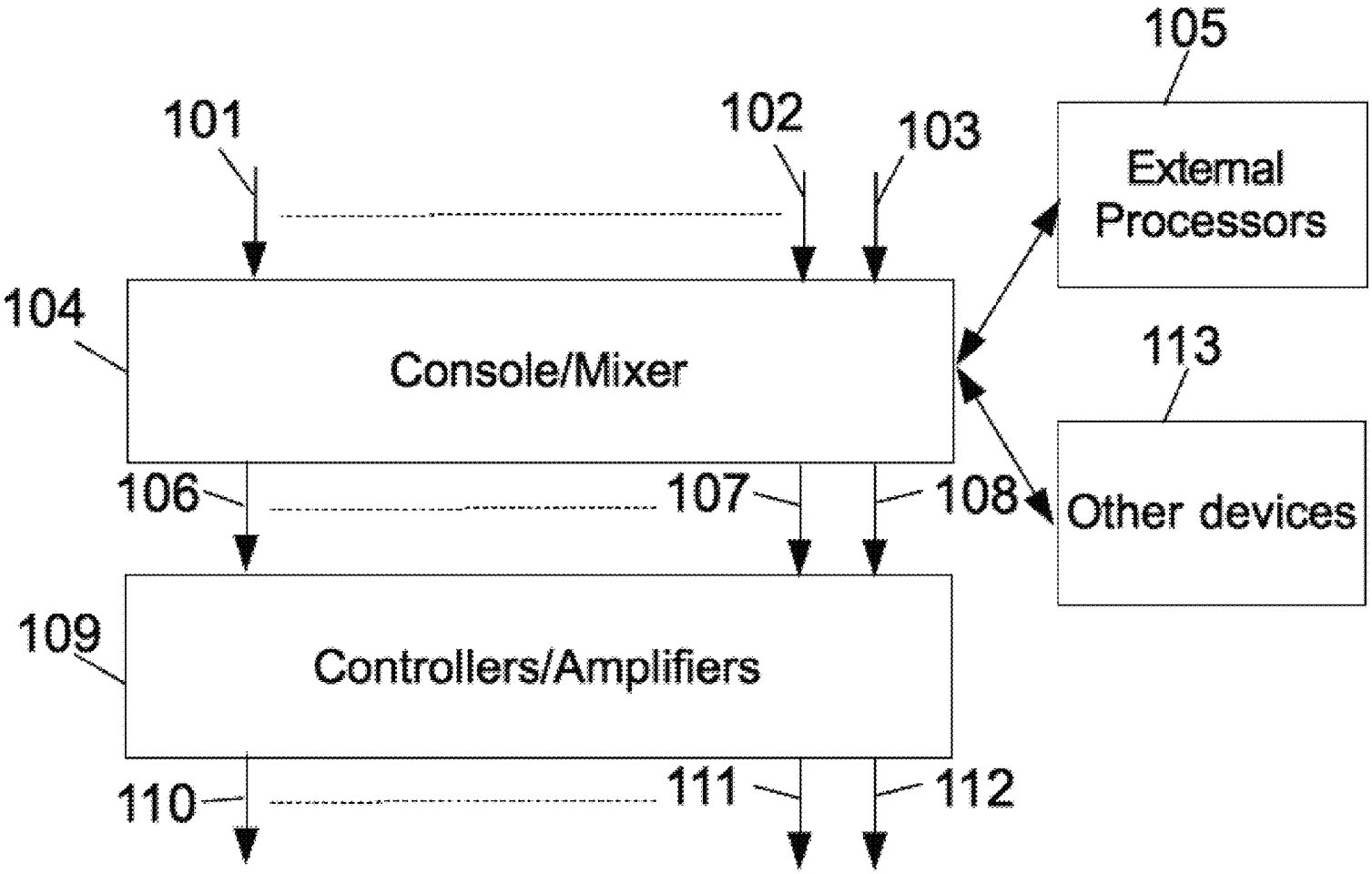
FIG. 1 illustrates an exemplary schematic representation of the sound setup of a live event.

FIG. 1 shows an exemplary embodiment of the sound setup of a live event. An arbitrary number of audio inputs 101, 102, 103 are fed into a console/mixer 104, although in particular embodiments none or more than one consoles or mixers can be used. The audio inputs can among others be analog and/or digital and they can be microphone inputs and/or line inputs. The input signals can be pre-processed before being routed into the console/mixer. Examples of data pre-processing include but are not limited to performing equalization, dynamic range compression, special effects, amplification or any other time or frequency or time-frequency domain manipulation. The input signals can be typically mixed and/or processed in the console/mixer 104 or by any external device 105. The processing can be made either in hardware or in software and it can be performed automatically or by a person, for example a sound engineer. An arbitrary number of audio outputs are routed into any other device 113 for example for recording, processing or any other type of operation. The data can be transmitted from the external device 113 back to the main console/mixer 104. An unlimited number of audio inputs 106, 107, 108 are routed from the console/mixer to the controllers/amplifiers 109. The signals that are routed in the controllers/amplifiers 109 can be further processed and reinforced. A number of audio outputs are produced 110, 111, 112 in order to be fed into the loudspeakers that can be active or passive, assembled in loudspeaker arrays, etc.

Figure 2:
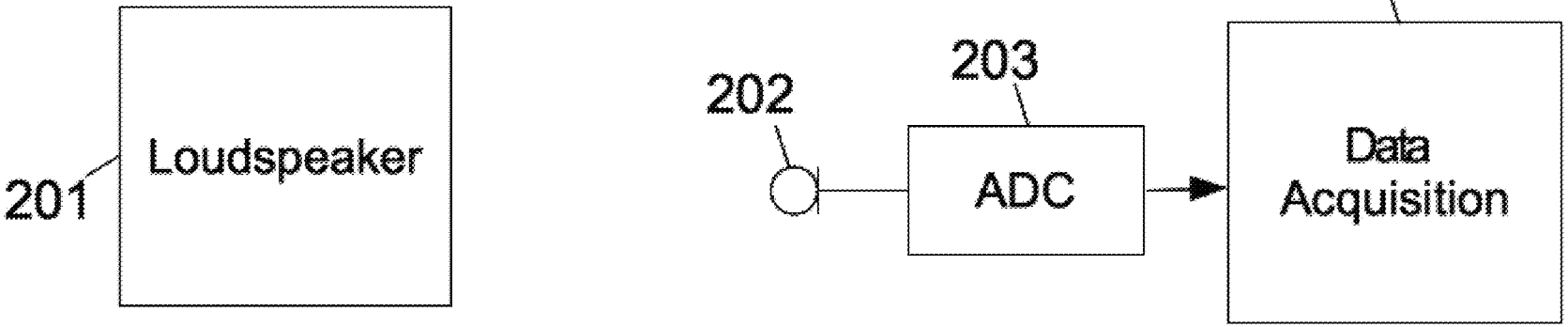
FIG. 2 illustrates an exemplary schematic representation of the setup of an acoustic measurement.

FIG. 2 illustrates an exemplary case of an acoustic measurement. Typically a sound signal is emitted via a loudspeaker 201 or any other apparatus capable for sound emission. An acoustic sensor 202 captures the signal of the loudspeaker and then the signal is digitized by an Analog to Digital Converter, i.e. an ADC 203. In a particular embodiment, the acoustic sensor can be any type of microphone. The acquired digital signal 204 might be processed, stored, analyzed, broadcasted, etc. When performing acoustic measurements, the emitted sound signal from the loudspeaker can be any type of signal such as a linear sine sweep signal, an exponential sweep signal, any type of random or pseudo-random noise, a Maximum Length Sequence (MLS) signal, a white noise signal, a brown noise signal, a pink noise signal, a group of sinusoids etc. In an exemplary embodiment, after the acquisition 204 of the signal emitted from the loudspeaker 201 an analysis of the signal is performed in order to extract meaningful information for the medium and the acoustic setup. The captured signal may contain information among others on the acoustic path. Here with the term acoustic path we refer to the auditory or any other contribution of the sound system (microphones, mixer/console, controllers, signal processors, amplifiers, loudspeakers, etc) as well as the venue. In particular embodiments, a deconvolution of the emitted signal (i.e. the input signal) x(t) from the acquired signal (i.e. the output signal) y(t) can be performed, extracting the Impulse Response (IR) of the acoustic path. Given the quantities x(t), y(t) and that the acoustic path can be reasonably approximated as a linear time-invariant (LTI) system, deconvolution can be for example performed in the frequency domain as $$h(t) = F^{-1}\left\{\frac{F\{y(t)\}}{F\{x(t)\}}\right\}$$

where F{ } is the forward Fourier transform, $F^{-1}${ } is the inverse Fourier transform and h(t) is the IR of the acoustic path. Alternatively the IR can be extracted in the time domain or with any suitable technique. There are several methods to measure the IR of an acoustic path using various types of excitation signals x(t) as for example described in [Stan, Guy-Bart and Embrechts, Jean-Jacques and Archambeau, Dominique, "*Comparison of Different Impulse Response Measurement Techniques*", J. Audio Eng. Soc., 50(4), p. 249-262]. All or any of these can be applied to this invention. The acquired signal and/or the IR can be used in order to perform meaningful acoustic analysis such as fractional-octave analysis, sound-level measurements, power spectra, frequency response measurements, transient analysis, etc. The analysis of the captured signal can be used in order to tune or calibrate any stage or aspect of the sound system, mainly by changing settings and/or adding/removing components to the system. The tuning of the system can be done either manually or automatically. In some embodiments, the tuning of the system might increase the sound quality either subjectively (for the audience during and after the event) or objectively (for recordings, broadcasting, etc).

Figure 3:
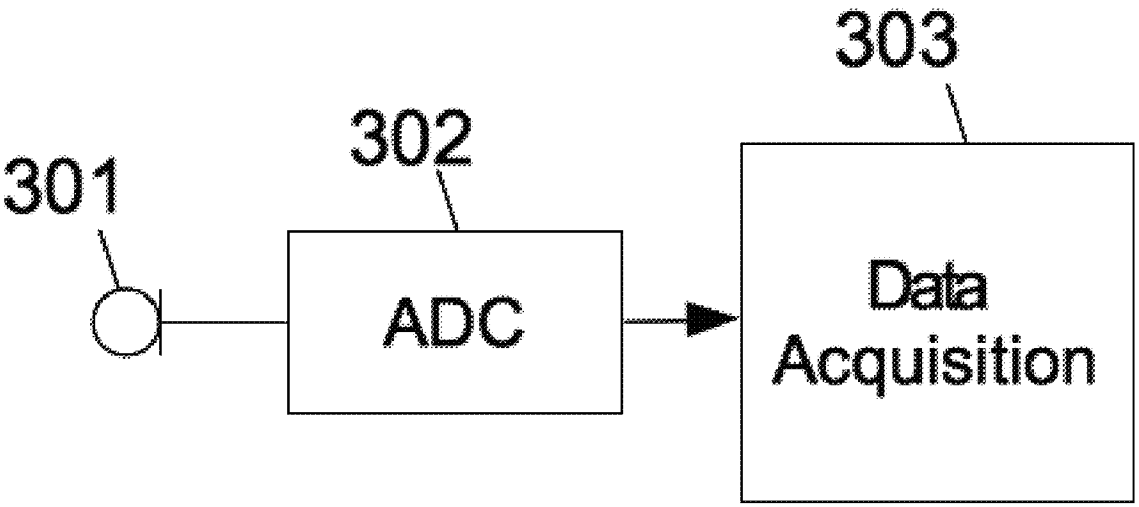
FIG. 3 illustrates an exemplary schematic representation of sound data acquisition.
Figure 4:
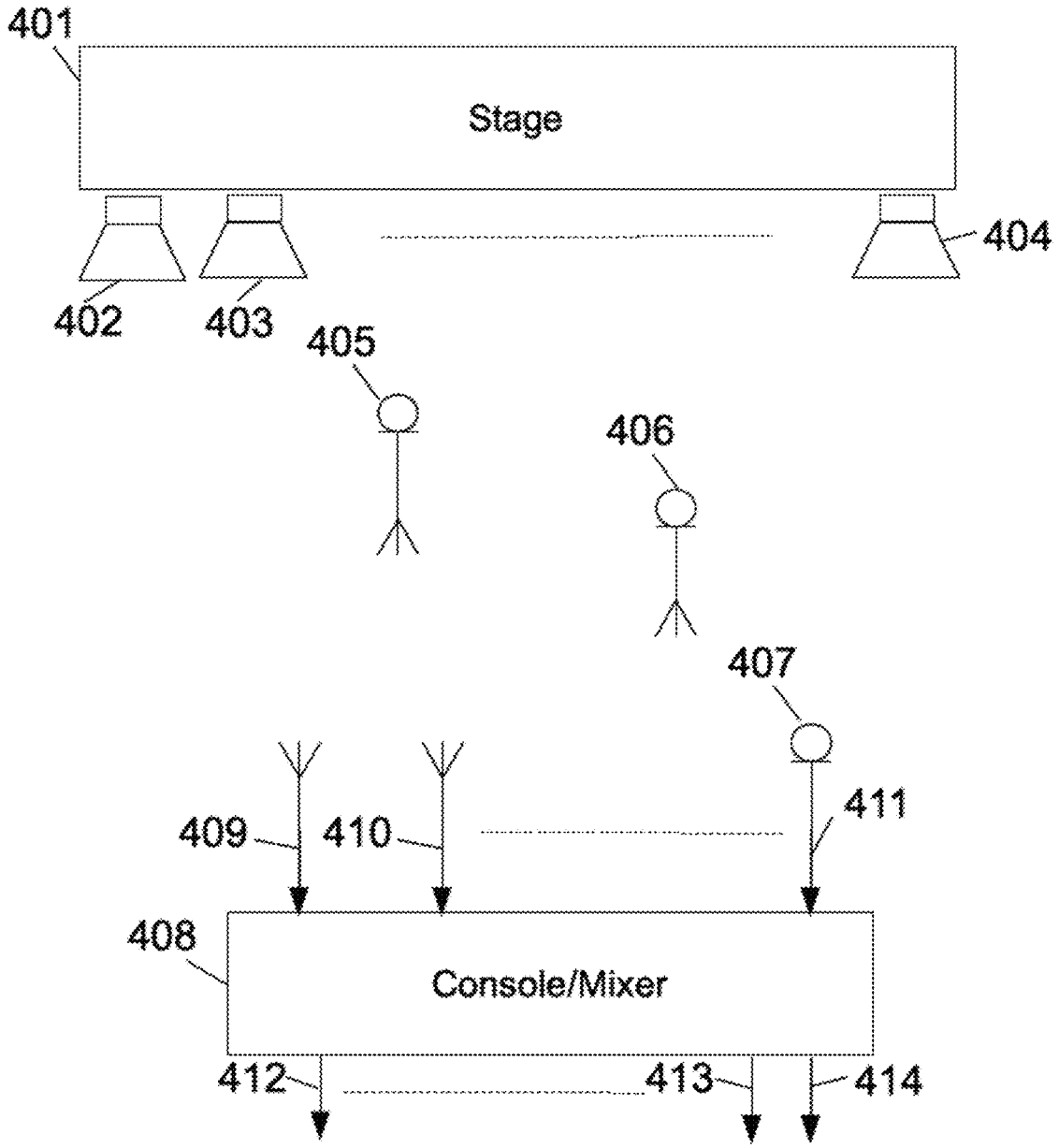
FIG. 4 illustrates an exemplary schematic representation of the sound setup for acoustic measurements in a live event.

FIG. 3 presents an exemplary embodiment of a data acquisition system that might be used to acquire meaningful sound data without the need for sound emission from a specific loudspeaker. An acoustic sensor 301 captures the data of the soundscape, transforms the data in the digital domain via an ADC 302 and acquires the data 303. The acquired data can be processed, stored, analyzed, broadcasted, etc. When possible a blind or semi-blind deconvolution can be performed in order to extract an estimation of the IR, see for example [Y. A. Huang, J. Chen, J. Benesty, "Blind identification of acoustic MIMO systems", in *Acoustic MIMO Signal Processing*, Springer US]. In other embodiments, the acquired data per se can be used in order to extract any meaningful acoustic parameters including but not limited to the sound level, loudness, frequency response of the soundscape, transient analysis, etc. In many cases, such parameters that are extracted directly from the captured data might give a good estimation of some characteristics of the acoustic path. In other cases, useful information for the coupling between the signal, the sound system and the acoustic medium can be extracted.

In a particular embodiment, acoustic measurements are performed in a venue. In a typical venue, there can be none, one or more stages where the event primarily takes place 401, none, one or more loudspeakers that reinforce the sound 402, 403, 404 and none, one or more consoles/mixers 408 with multiple inputs 409, 410, 411 and outputs 412, 413, 414. The inputs may be wireless 409, 410 or wired 411. In order to improve the acoustic characteristics, the acoustic path from the sound system to each position of interest can be improved. In some embodiments, one or more microphones are placed inside the venue 405, 406, 407 and connected wirelessly 405, 406 or via a wired connection 407 to the inputs of the console mixer. Alternatively the microphones can be connected to the inputs of any device that can perform acoustic measurements or acquire sound. In a particular example, a sound signal can be routed from the console to the loudspeakers and captured via the microphones. The captured signal can be processed in order to extract meaningful information for the acoustic path. Ideally, every location of interest must be measured and an infinite number of microphones must be placed inside the venue. Since this is practically impossible, in prior art a limited number of measurements are usually performed using one or more microphones and typically the acoustic measurements take place before the event. However, the acoustic conditions during the event change significantly, due to different environmental conditions and the presence of the audience. Therefore, the practical value of such acoustic measurements is limited.

Figure 5:
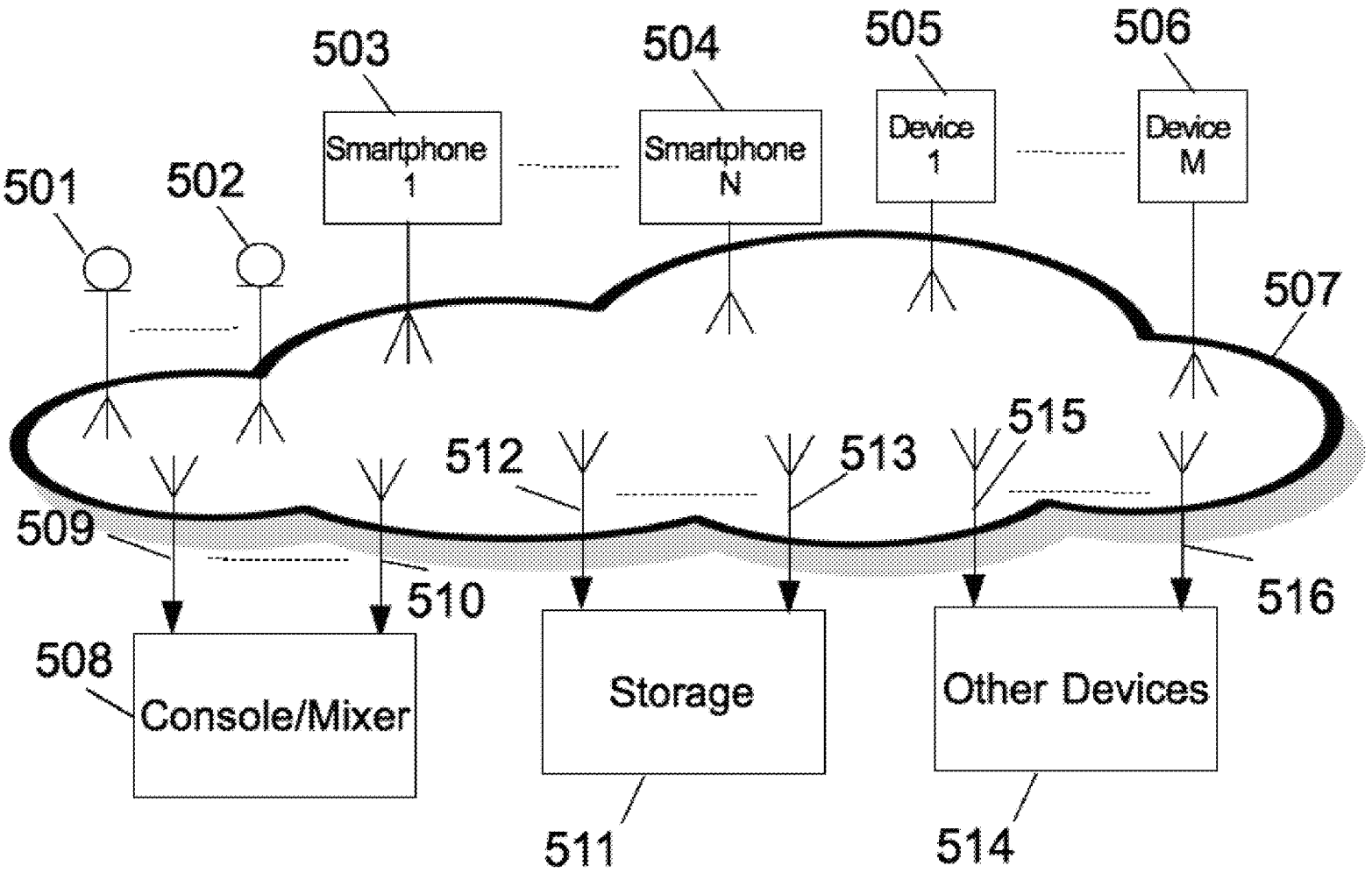
FIG. 5 illustrates an exemplary schematic representation of wireless data exchange in a live event.

FIG. 5 illustrates an exemplary embodiment where any sound-capturing device carried by the audience in a venue is used in order to provide information for the acoustic paths. Example sound-capturing devices include but are not limited to smartphones, tablet computers, laptop or desktop computers, head-mounted or otherwise wearable computers, portable recorders, video cameras, headphones, hats, headbands, earpieces or any other type of wearable or hand-held computer. Generally sound-capturing devices can have one or more microphones. In FIG. 5 any number of smartphones 503, 504 or any other sound-capturing device 505, 506 can be used. Such devices are carried by the audience and are scattered across the venue and they can provide sound data captured practically in every audience location. The data of said devices can sometimes be used together with data provided by any number of existing microphones 501, 502 in order to transmit data to the inputs 509, 510 of the console/mixer 508, to one or more storage devices 511, 512, 513 or to any other device 514, 515, 516. The sound data can be transmitted either wirelessly or via a wired connection. The transmitted data can be pre-processed. Examples of data pre-processing include but are not limited to performing a fast Fourier transform (FFT), short time Fourier transform (STFT), magnitude/phase calculation, power spectral density (PSD) estimation, or calculating linear predictive coding (LPC) coefficients and/or beamforming parameters.

The data from the sound-capturing devices can be used to extract the impulse or frequency response of the acoustic path in each position. In addition the captured data can be used to extract parameters like: spectrum magnitude and phase, coherence, correlation, delay, spectrogram or any other time, frequency or time-frequency representation, stereo power balance, signal envelopes and transients, sound power or sound pressure level, loudness, peak or RMS level values, Reverberation Time (RT), Early Decay Time (EDT), Clarity (C), Definition or Deutlichkeit (D), Center of Gravity (TS), Interaural Cross Correlation (IACC), Lateral Fraction (LF/LFC), Direct to Reverberation Ratio, Speech Transmission Index (STI), Room Acoustics Speech Transmission Index (RASTI), Speech Transmission Index for Public Address Systems (STIPA), Articulation Loss of Consonants (% ALCons), Signal to Noise Ratio (SNR), Segmental Signal to Noise Ratio, Weighted Spectral Slope (WSS), Perceptual Evaluation of Speech Quality (PESQ), Perceptual Evaluation of Audio Quality (PEAR), Log-Likelihood Ratio (LLR), Itakura-Saito Distance, Cepstrum Distance, Signal to Distortion Index, Signal to Interference Index or any other quantity that gives information on the acoustic paths or the emitted signals. Any such quantity can be presented/transmitted for the full audible frequency range or for any subset of the audible frequencies. Such information can be used in order to calibrate or tune the sound system and/or alter the captured signals. In another embodiment, sound-capturing devices carried by the audience might use the captured data and their own processing power in order to calculate any quantity that gives information on the acoustic paths or the signals. The calculated quantities can be transmitted with or without the captured sound signals to the console/mixer 508, any storage device 511 or any other appropriate device 514. The transmitted quantities can be used in order to manually or automatically change settings at any stage of the sound system or change the sound system topology. In some embodiments, the captured data can be sometimes transmitted together with location data and used in order to produce acoustic maps, i.e. graphic representations of the distributions of a certain quantities in a given region of the venue. In another embodiment, location data of each sound-capturing device can be determined by any appropriate technique at the console/mixer. These acoustic maps can be used to calibrate the sound system even during the live event, in a way that an improved auditory experience will be ensured for all audience positions.

Figure 6:
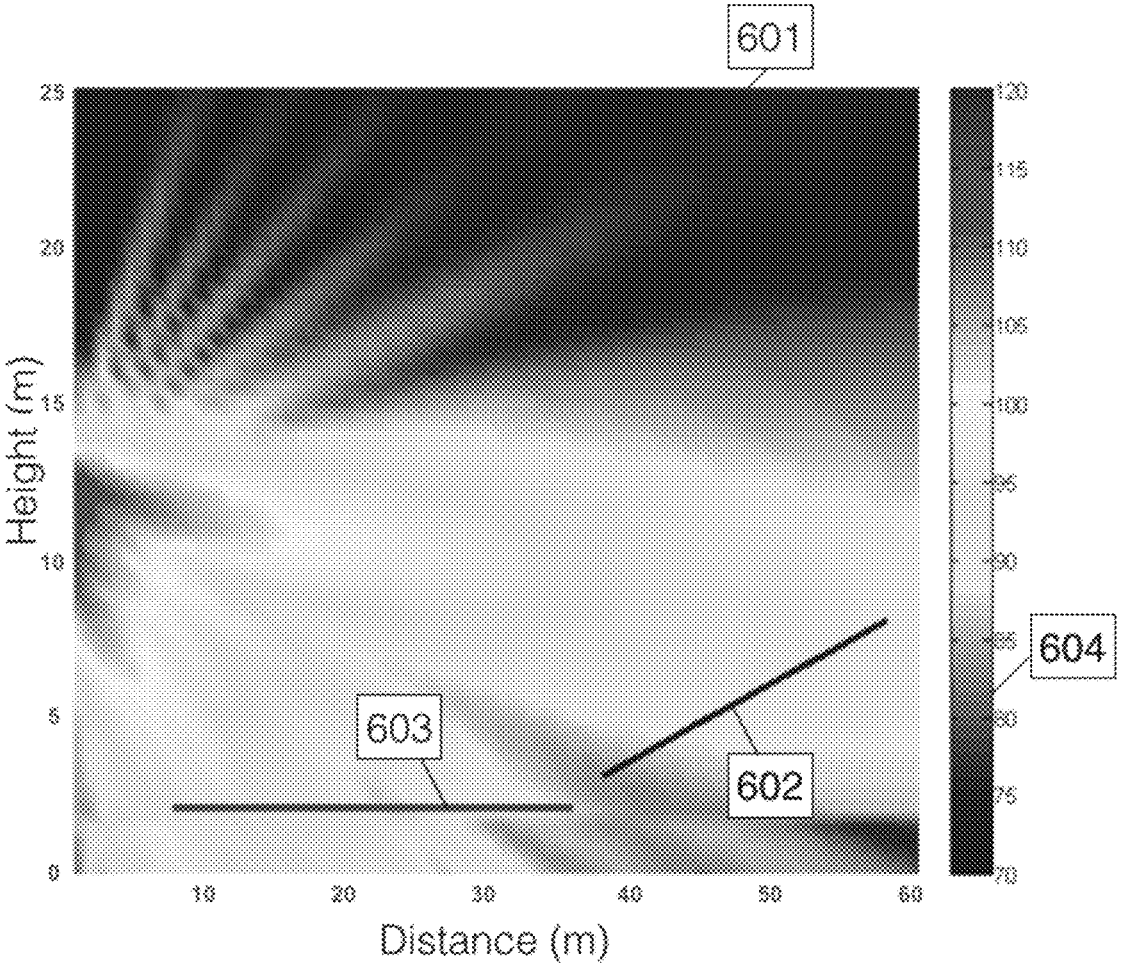
FIG. 6 illustrates an exemplary schematic representation of an acoustic map.

FIG. 6 shows an exemplary illustration of an acoustic map where a graphic representation of the sound level distribution in a venue 601 is presented. In this particular embodiment, the sound pressure level for a specific frequency emitted by the loudspeakers towards the audience locations 602, 603 is presented, while the gray color variations depict sound pressure level values in dB. Typically before a live event broad simulations of such acoustic maps for several frequencies are created, mainly using assumptions on the characteristics of the loudspeakers and venue architecture. Such coarse simulated maps along with sparse acoustic measurements provide the guidelines for tuning the sound system. However, such simulations are not accurate and don't take into account the change of acoustic conditions during the event.

In the present embodiment, detailed acoustic maps can be available to a sound engineer in real-time during the event so that she/he can continuously improve the auditory experience of the audience. In the present embodiment, instead of creating the acoustic maps via simulations or sparse measurements, accurate acoustic maps are created via real-time data acquisition using the sensors of the sound-capturing devices of the audience. Note that since the acoustic maps of the present embodiment can be dynamically updated in real-time any change of the acoustic conditions can be taken into account. For example, sometimes due to equipment malfunctions, sound engineers may replace the sound gear (e.g. microphones, guitar or bass cabins and amplifiers, etc) at the time of the live event. In the present embodiment the sound system can be automatically or manually re-tuned to compensate for any change in the acoustic conditions. In other embodiments, loudspeakers (typically monitor speakers for the musicians) and microphones located on stage of the live event can be used in order to produce acoustic maps with meaningful acoustic data for the stage area. Since sound engineering techniques rely heavily on the manipulation of the spectral content, sometimes there might not be a need for data transmission of the whole audible frequency range. In another embodiment, sound data limited in frequency bands can be provided from the sound-capturing devices in a way that a potential problem might be identified in a specific spectral region. By limiting the frequency band of interest, the amount of transmitted data can be efficiently reduced. Generally, any subset of the captured signal can be transmitted from the sound capturing devices. In all cases, when a sound engineer has access to detailed acoustic maps she/he can use typical engineering tools and techniques to tune the sound system including but not limited to hardware or software equalizers, dynamic range compressors, change of the microphone and/or source positions, etc.

In some embodiments, special signals including but not limited to sine sweeps, MLS noise, etc can be reproduced from the loudspeakers and captured from the sound-capturing devices in order to better estimate the acoustic paths. In other embodiments, said special signals can be presented alone or "hidden" in the music of the main event. For example, if such signals are not audible to the audience (because, e.g. they are masked by other sounds) they do not have a negative effect on the auditory experience while providing valuable information to better estimate acoustic paths. In other embodiments, the frequency content of these signals can be in the non-audible range.

Figure 7:
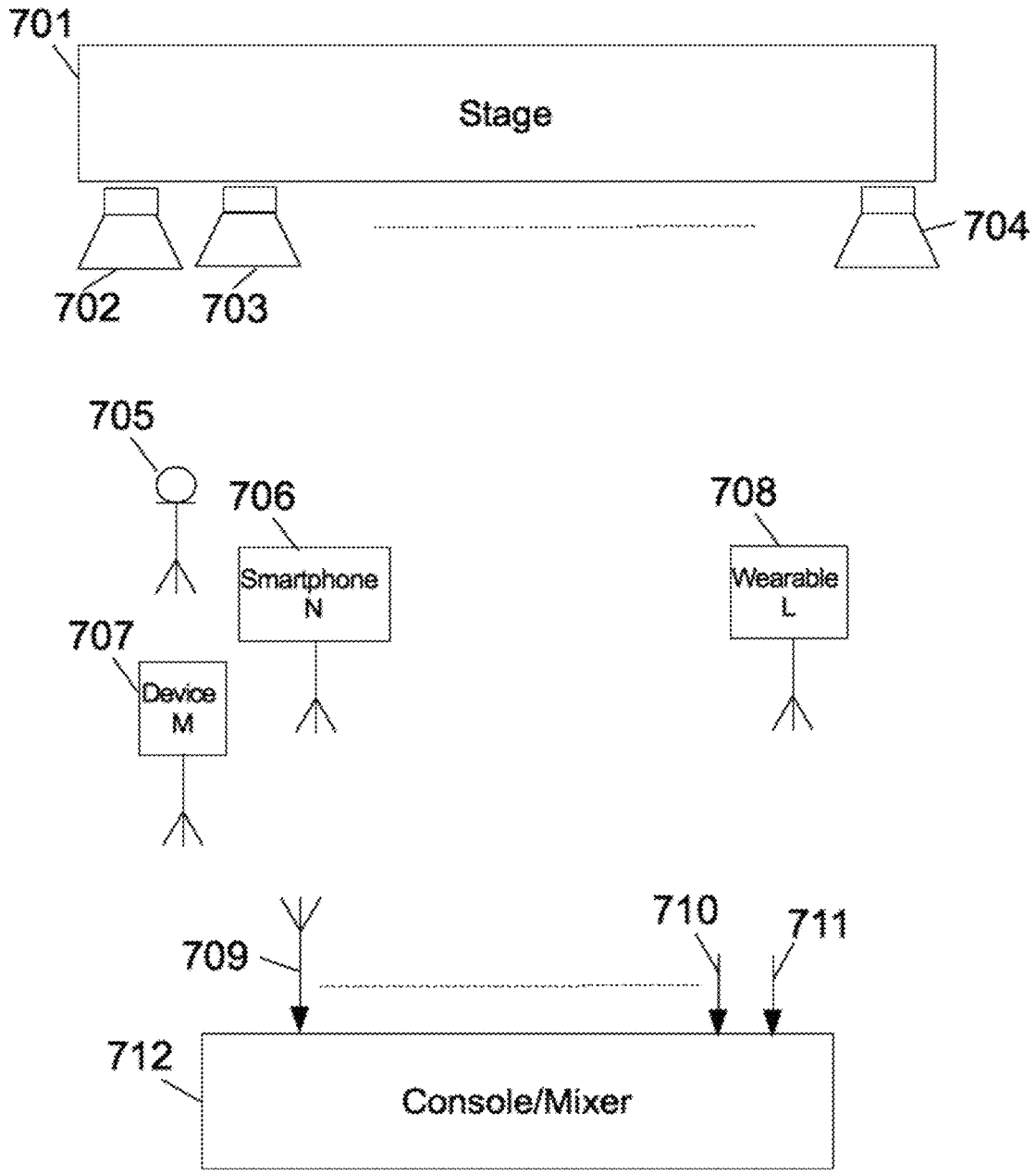
FIG. 7 illustrates an exemplary schematic representation of sound-capturing devices exchanging data in a venue.

FIG. 7 illustrates an exemplary embodiment where a live event takes place on a stage 701 or anywhere in a venue and is being reproduced from one or more loudspeakers 702, 703, 704. The event is controlled by a mixer/console 712 with several wireless 709 or wired inputs 710, 711. The audience of the event may carry sound-capturing devices, for example smartphones 706, wearable devices 708 or any other device 707. Moreover, wireless 705 or wired microphones can be given to the audience by the event organizers. The audience may use said devices in order to capture sound and transmit it to the console/mixer. For example in the case of a music event, the audience can sing along with the event's music and capture the singing voices with the sound-capturing devices 705, 706, 707, 708. Selected smart-capturing devices can be grouped together 705, 706, 707, while other devices 708 can be treated as unique sound sources. In some embodiments, the captured singing voices can be combined and used to produce any kind of sound effect, for example choir effects, phase shifting effects, chorus effects, delay effects, doubling effects, etc. In other embodiments, the captured voices can be mixed with one or more of the stage voices or replace one or more of the stage voices. In this way, the audience members will have the feeling of singing along with the musicians. In all embodiments the captured singing voices of the audience can be mixed with the rest of the music and reproduced in real-time in the venue, broadcasted or recorded. The singing voices of the audience can be also used to create karaoke type competitions during or after live events. The audience voices can be also recorded and mixed with the original event's music in order to create a personalized version of the concert that would be purchased by interested members of the audience. Data from other sensors of the sound-capturing devices (for example video data) can be also combined with the audio data in order to enhance the user-experience and create multimedia content. The recording/mixing can be done manually or automatically. The content can be produced in real time so that the audience can purchase the content right after the event.

In another embodiment, the use of a bidirectional communication channel (audio and video) between the sound-capturing devices and the mixing/console can enable the sound engineer to route audio or video to the device's speakers in order to create effects during the concert. For example, a sound effect where the main PA system is muted and thousands of speakers of the crowd's devices are activated can be created. In another embodiment, real-time video from and to the main stage can be transmitted using the crowd's devices. Such user-experience enhancements can be combined with other applications including but not limited to in-concert competitions, crowd balloting for the next songs, multimedia contests, sales of tickets for future concerts, in-app sales of music, etc.

In another embodiment, data from sound-capturing devices can be explored in order to compliment the main microphones when mixing or processing the live concert and resulting for example in multichannel audio reproduction, new sound effects, specific directivity patterns, better speech intelligibility and sound clarity, spatial allocation of sounds or sound sources, etc. A signal decomposition step might be also used in order to produce more meaningful input signals as proposed in the U.S. patent application Ser. No. 14/265,560.

In another embodiment, sound-capturing devices of audience that participate in the event through broadcasting can exchange data wirelessly with the event console/mixer. Therefore, sound or video data from remote audience members can be available to the sound engineer.

In some embodiments, the network of the sound-capturing devices can be an ad-hoc network. In other embodiments, the network of the sound-capturing devices can be a centralized network. A server acting as a router or access point may manage the network. The server can be located in the mixing/console of the live event or in any other appropriate location.

In particular embodiments, the sound-capturing devices may transmit data wirelessly. For this, any wireless data transmission may be used included but not limited to Bluetooth, communication protocols described in IEEE 802.11 (including any IEEE 802.11 revisions), communication protocols described in IEEE 802.1 (including any IEEE 802.1 revisions), cellular technology (such as GSM, CDMA, UMTS, EV-DO, WiMAX, or LTE), Zigbee, or any communications technologies used for the Internet of Things (IoT).

In particular embodiments, time data can be transmitted from the sound-capturing devices. Said time-data can be autonomous or linked with sound data, sometimes resulting in time-stamped sound data. In another embodiment, location data determining the exact or relative location of each sound-capturing device can be transmitted. In some embodiments, the location of a sound-capturing device relative to a second sound-capturing device or a plurality of sound-capturing devices can be determined or the location can be pre-determined beforehand. In another embodiment, the receiving device (for example the mixer/console) or any other device can determine the location of each sound-capturing device. This can be done via any standard location-tracking technique including but not limited to triangulation, trilateration, multilateration, WiFi beaconing, magnetic beaconing, etc. In another embodiment, the data can be transmitted continuously, periodically, as requested by the receiver, or in response to any another trigger. In another embodiment, data from other sensors can be transmitted from the sound-capturing devices including but not limited to video cameras, still cameras, Global Positioning System (GPS) receivers, infra red sensors, optical sensors, biosensors, Radio Frequency Identification (RFID) systems, wireless sensors, pressure sensors, temperature sensors, magnetometers, accelerometers, gyroscopes, and/or compasses.

While the above-described flowcharts have been discussed in relation to a particular sequence of events, it should be appreciated that changes to this sequence can occur without materially effecting the operation of the invention. Additionally, the exemplary techniques illustrated herein are not limited to the specifically illustrated embodiments but can also be utilized and combined with the other exemplary embodiments and each described feature is individually and separately claimable.

Additionally, the systems, methods and protocols of this invention can be implemented on a special purpose computer, a programmed micro-processor or microcontroller and peripheral integrated circuit element(s), an ASIC or other integrated circuit, a digital signal processor, a hard-wired electronic or logic circuit such as discrete element circuit, a programmable logic device such as PLD, PLA, FPGA, PAL, a modem, a transmitter/receiver, any comparable means, or the like. In general, any device capable of implementing a state machine that is in turn capable of implementing the methodology illustrated herein can be used to implement the various communication methods, protocols and techniques according to this invention.

Furthermore, the disclosed methods may be readily implemented in software using object or object-oriented software development environments that provide portable source code that can be used on a variety of computer or workstation platforms. Alternatively the disclosed methods may be readily implemented in software on an embedded processor, a micro-processor or a digital signal processor. The implementation may utilize either fixed-point or floating point operations or both. In the case of fixed point operations, approximations may be used for certain mathematical operations such as logarithms, exponentials, etc. Alternatively, the disclosed system may be implemented partially or fully in hardware using standard logic circuits or VLSI design. Whether software or hardware is used to implement the systems in accordance with this invention is dependent on the speed and/or efficiency requirements of the system, the particular function, and the particular software or hardware systems or microprocessor or microcomputer systems being utilized. The systems and methods illustrated herein can be readily implemented in hardware and/or software using any known or later developed systems or structures, devices and/or software by those of ordinary skill in the applicable art from the functional description provided herein and with a general basic knowledge of the audio processing arts.

Moreover, the disclosed methods may be readily implemented in software that can be stored on a storage medium, executed on programmed general-purpose computer with the cooperation of a controller and memory, a special purpose computer, a microprocessor, or the like. In these instances, the systems and methods of this invention can be implemented as program embedded on personal computer such as an applet, JAVA® or CGI script, as a resource residing on a server or computer workstation, as a routine embedded in a dedicated system or system component, or the like. The system can also be implemented by physically incorporating the system and/or method into a software and/or hardware system, such as the hardware and software systems of an electronic device.

It is therefore apparent that there has been provided, in accordance with the present invention, systems and methods for wireless exchange of data between devices in live events. While this invention has been described in conjunction with a number of embodiments, it is evident that many alternatives, modifications and variations would be or are apparent to those of ordinary skill in the applicable arts. Accordingly, it is intended to embrace all such alternatives, modifications, equivalents and variations that are within the spirit and scope of this invention.

What is claimed is:

1. A sound system for a live music event which includes singing voices and music comprising:

a console connected wirelessly with a plurality of sound capturing devices, wherein the sound capturing devices are located in an audience area of a live event, wherein an audience uses the sound capturing devices to capture a sound of their voices when they sing along with artists performing live music;

wherein the sound capturing devices capture singing voices of the audience and create a plurality of audience sound signals from the singing voices of the audience; and a receiver, connected to the console, that requests one or more of the sound capturing devices to transmit one or more of the audience sound signals and receives the one or more audience sound signals from the sound capturing devices;

the receiver, connected to the console, also requests that one or more of the sound capturing devices transmit one or more acoustic parameters and receive the one or more acoustic parameters from the sound capturing devices, wherein the acoustic parameters are utilized to represent acoustic paths between one or more of the plurality of sound capturing devices and a stage of the live music event;

the console further receiving the audience sound signals and the acoustic parameters and storing and mixing the audience sound signals; and a public address system, connected to the console, that broadcasts to the audience a combination of the live music being performed by the artists and the one or more audience sound signals.

2. The system of claim 1, wherein the sound capturing devices are one or more of smartphones, tablet computers, laptop or desktop computers, head-mounted or otherwise wearable computers, portable recorders, video cameras, headphones, hats, headbands, earpieces or any other type of wearable or hand-held computer.

3. The system of claim 1, wherein the live event is one or more of sport event, political gathering, festival, religious ceremony, TV show, game, music event, theatre event, dance event and art performance.

4. The system of claim 1, wherein the system is implemented in a digital mixing desk.

5. The system of claim 1, wherein the music signals are live music signals or pre-recorded music signals.

6. A method for using a sound system for a live music event which includes singing voices and music comprising:

wirelessly connecting with a plurality of sound capturing devices, wherein the sound capturing devices are located in an audience area of a live event, wherein an audience uses the sound capturing devices to capture sound of their voices when they sing along with artists performing live music;

wherein the sound capturing devices capture singing voices of the audience and create a plurality of audience sound signals from the singing voices of the audience; and requesting, by a receiver connected to a console, one or more of the sound capturing devices to transmit one or more of the audience sound signals and receive the one or more audience sound signals from the sound capturing devices;

requesting, by the receiver, that one or more of the sound capturing devices transmit one or more acoustic parameters and receive the one or more acoustic parameters from the sound capturing devices, wherein the acoustic parameters are utilized to represent acoustic paths between one or more of the plurality of sound capturing devices and a stage of the live music event;

receiving the audience sound signals and the acoustic parameters and storing and mixing, by console, the audience sound signals from the receiver; and broadcasting, by a public address system, to the audience a combination of the live music being performed by the artists and the one or more audience sound signals.

7. The method of claim 6, wherein the sound capturing devices are one or more of smartphones, tablet computers, laptop or desktop computers, head-mounted or otherwise wearable computers, portable recorders, video cameras, headphones, hats, headbands, earpieces or any other type of wearable or hand-held computer.

8. The method of claim 6, wherein the live event is one or more of sport event, political gathering, festival, religious ceremony, TV show, game, music event, theatre event, dance event and art performance.

9. The method of claim 6, wherein the system is implemented in a digital mixing desk.

10. The method of claim 6, wherein the music signals are live music signals or pre-recorded music signals.

* * * * *